US007966914B2

(12) United States Patent
Abdelgany

(10) Patent No.: US 7,966,914 B2
(45) Date of Patent: Jun. 28, 2011

(54) SCREWDRIVER HANDLE

(75) Inventor: Mahmoud F. Abdelgany, Rockaway, NJ (US)

(73) Assignee: Custom Spine, Inc., Parsippany, NJ (US)

( * ) Notice: Subject to any disclaimer, the term of this patent is extended or adjusted under 35 U.S.C. 154(b) by 0 days.

(21) Appl. No.: 11/734,583

(22) Filed: Apr. 12, 2007

(65) Prior Publication Data

US 2008/0092697 A1 Apr. 24, 2008

Related U.S. Application Data

(63) Continuation-in-part of application No. 11/076,670, filed on Mar. 10, 2005, now Pat. No. 7,216,569.

(51) Int. Cl.
*B25B 15/02* (2006.01)
*B25B 17/00* (2006.01)
*B25B 21/00* (2006.01)

(52) U.S. Cl. ..... 81/177.6; 81/57.11

(58) Field of Classification Search ..... 81/177.5, 81/57.11, 177.6, 177.7
See application file for complete search history.

(56) References Cited

U.S. PATENT DOCUMENTS 1,036,379 A * 8/1912 Tibbals ..... 81/58.4
1,559,097 A * 10/1925 Hill ..... 81/177.2
1,835,943 A * 12/1931 Hoss ..... 81/30
2,726,695 A 6/1951 Malm
2,629,413 A * 2/1953 Stettler ..... 81/490
2,635,661 A * 4/1953 Egan ..... 81/490
2,774,401 A * 12/1956 Hallam ..... 81/457
3,124,374 A * 3/1964 Krapp ..... 285/85
3,186,009 A * 6/1965 Simmons ..... 7/168
3,687,179 A * 8/1972 Totsu ..... 81/475
3,750,729 A * 8/1973 Lemieux ..... 81/439
3,753,455 A * 8/1973 Butler ..... 81/439
3,844,322 A * 10/1974 Stoutenberg ..... 81/33
4,078,589 A * 3/1978 Miller ..... 81/57.14
4,542,667 A * 9/1985 Jang ..... 81/177.2
4,573,487 A * 3/1986 Schultes et al. ..... 135/24
4,590,824 A * 5/1986 Cushman ..... 81/440
4,647,075 A * 3/1987 Vargo ..... 285/82
4,653,358 A * 3/1987 Lankry ..... 81/474
4,815,346 A * 3/1989 Littlehorn ..... 81/439
4,996,896 A * 3/1991 Bachand et al. ..... 81/450
5,016,501 A * 5/1991 Holzer, Jr. ..... 81/57.11
5,228,363 A * 7/1993 Corona et al. ..... 81/439
5,484,440 A * 1/1996 Allard ..... 606/916
5,737,982 A * 4/1998 Lin ..... 81/58.3
6,032,332 A * 3/2000 Lin ..... 16/111.1
6,257,351 B1 * 7/2001 Ark et al. ..... 173/178
6,273,200 B1 * 8/2001 Smith et al. ..... 173/216
6,314,600 B1 * 11/2001 Cachot ..... 7/128
6,332,384 B1 * 12/2001 Cluthe ..... 81/490

(Continued)

*Primary Examiner* — David B. Thomas
(74) *Attorney, Agent, or Firm* — Rahman LLC

(57) ABSTRACT

A screwdriver handle comprising a base portion adapted to accommodate a screwdriver shaft member; at least one arm pivotally connected to the base portion; a locking sleeve mounted on the base portion; and an electric motor operatively connected to the base portion and adapted to rotate the screwdriver shaft member in any of a clockwise and counterclockwise manner. The screwdriver handle may further comprise a switch adapted to turn the motor on and off. Additionally, the screwdriver handle may further comprise an electromechanical actuator operatively connected to each of the electric motor and the locking sleeve. Preferably, the locking sleeve is adapted to move along a longitudinal axis of the base portion, and wherein the electromechanical actuator is adapted to prevent the locking sleeve from moving along the longitudinal axis of the base portion.

20 Claims, 9 Drawing Sheets

U.S. PATENT DOCUMENTS 6,405,807 B1 * 6/2002 Pan ..... 173/217
6,533,291 B2 * 3/2003 Huggins et al. ..... 279/29
6,877,186 B2 * 4/2005 Shiao ..... 16/111.1
7,182,002 B2 * 2/2007 Hu ..... 81/177.4
7,216,569 B2 * 5/2007 Abdelgany ..... 81/177.5
7,237,458 B2 * 7/2007 Shiao ..... 81/62
7,287,450 B1 * 10/2007 Liao ..... 81/177.9
7,311,027 B1 * 12/2007 Tatsuno et al. ..... 81/469
D580,725 S * 11/2008 Bublitz et al. ..... D8/68
2003/0024594 A1 * 2/2003 Szewc et al. ..... 140/124
2006/0201287 A1 * 9/2006 Abdelgany ..... 81/177.5
2008/0041194 A1 * 2/2008 Beauchamp ..... 81/177.4

* cited by examiner

SCREWDRIVER HANDLE

CROSS-REFERENCE TO RELATED APPLICATION

This application is a continuation-in-part of U.S. patent application Ser. No. 11/076,670 filed on Mar. 10, 2005 now U.S. Pat. No. 7,216,569, the contents of which, in its entirety, is herein incorporated by reference.

BACKGROUND

1. Technical Field

The embodiments herein generally relate to power tools and, more particularly, to power tool handles.

2. Description of the Related Art

Screwdrivers are configured with a wide assortment of handles to help the user secure a proper grip. Most screwdriver handles have various forms of indent features or gripping areas to allow a user to secure a better grip. However, users may not be able to properly get a good ergonomic grip when using screwdrivers, especially when high torque applications are involved such as trying to dislodge a rusted screw.

Several power screwdrivers exist to assist a user for driving a screw into another object. These power screwdrivers typically include a motor that facilitates the shaft rotation of the screwdriver. However, even power screwdrivers may not provide the sufficient torque to drive screws, bolts, pins, etc. in high torque applications, and typically the power screwdriver drives the screw only until the point where the resistance equals the torque being applied. At this point, the user either has to further drive the screw manually either using the power screwdriver with the power turned off, or by using a typical non-power screwdriver. While, one may consider simply increasing the available torque of the motor to permit the screwdriver to operate in higher torque applications, such solutions may not be ideal due to the expense of higher torque motors, the increased size and weight of higher torque motors make using the power screwdriver cumbersome, and more of a burden to carry, and these higher torque motors still may not provide as much torque as a user can provide by mechanically rotating the screwdriver himself. Therefore, it is desirable to develop a novel screwdriver handle capable of allowing a user to use the screwdriver, including power screwdrivers, in higher torque applications.

SUMMARY

In view of the foregoing, an embodiment herein provides a screwdriver handle comprising a base portion adapted to accommodate a screwdriver shaft member; at least one arm pivotally connected to the base portion; a locking sleeve mounted on the base portion; and an electric motor operatively connected to the base portion and adapted to rotate the screwdriver shaft member in any of a clockwise and counterclockwise manner. The screwdriver handle may further comprise a switch adapted to turn the motor on and off. Additionally, the screwdriver handle may further comprise an electromechanical actuator operatively connected to each of the electric motor and the locking sleeve. Preferably, the locking sleeve is adapted to move along a longitudinal axis of the base portion, and wherein the electromechanical actuator is adapted to prevent the locking sleeve from moving along the longitudinal axis of the base portion.

Preferably, the at least one arm is adapted to articulate from a first position planar to a longitudinal axis of the base portion to a second position transverse to the longitudinal axis of the base portion, wherein the motor is adapted to be disabled when the at least one arm is in the second position. The at least one arm preferably comprises two arms, wherein the two arms are diametrically opposed to one another when in the second position. The screwdriver handle may further comprise a pin connecting the at least one arm to the base portion, wherein the base portion comprises at least one gripping indent feature. Preferably, the locking sleeve is adapted to engage the at least one arm. Preferably, the at least one arm comprises a pair of arms that are unconnected to one another.

Another embodiment provides a tool handle comprising a base portion adapted to accommodate a shaft member; a pair of arms operatively connected to the base portion, wherein the pair of arms are diametrically opposed to one another at a position transverse to a longitudinal axis of the base portion; and an electric motor operatively connected to the base portion. The tool handle may further comprise a locking sleeve mounted around the base portion and adapted to engage the pair of arms; a spring member mounted around the base portion and adapted to engage the locking sleeve; a torsion spring connected to the base portion and each of the pair of arms; and an electromechanical actuator operatively connected to each of the electric motor and the locking sleeve. Preferably, the base portion comprises a hollow inner shaft chamber. Moreover, the shaft member may comprise any of a screwdriver shaft member and a wrench shaft member. Also, the pair of arms are preferably adapted to articulate from a first position planar to a longitudinal axis of the base portion to a second position transverse to the longitudinal axis of the base portion, wherein the pair of arms may be diametrically opposed to one another when in the second position. The tool handle may further comprise a pin connecting the pair of arms to the base portion, wherein the base portion comprises at least one gripping indent feature. Preferably, the locking sleeve is adapted to move along a longitudinal axis of the base portion. Furthermore, the pair of arms are preferably unconnected to one another.

Another embodiment provides a tool handle comprising a base portion configured to accommodate a rotatable shaft member; a pair of arms pivotally connected to the base portion; locking means for locking the pair of arms in a first position planar to a longitudinal axis of the base portion; first energy means for providing energy to the locking means to articulate from a locked to an unlocked position; second energy means for providing energy to the pair of arms to articulate from the first position planar to the longitudinal axis of the base portion to a second position transverse to the longitudinal axis of the base portion; and electric power means for providing power to rotate the rotatable shaft member.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION OF PREFERRED EMBODIMENTS

Figure 1:
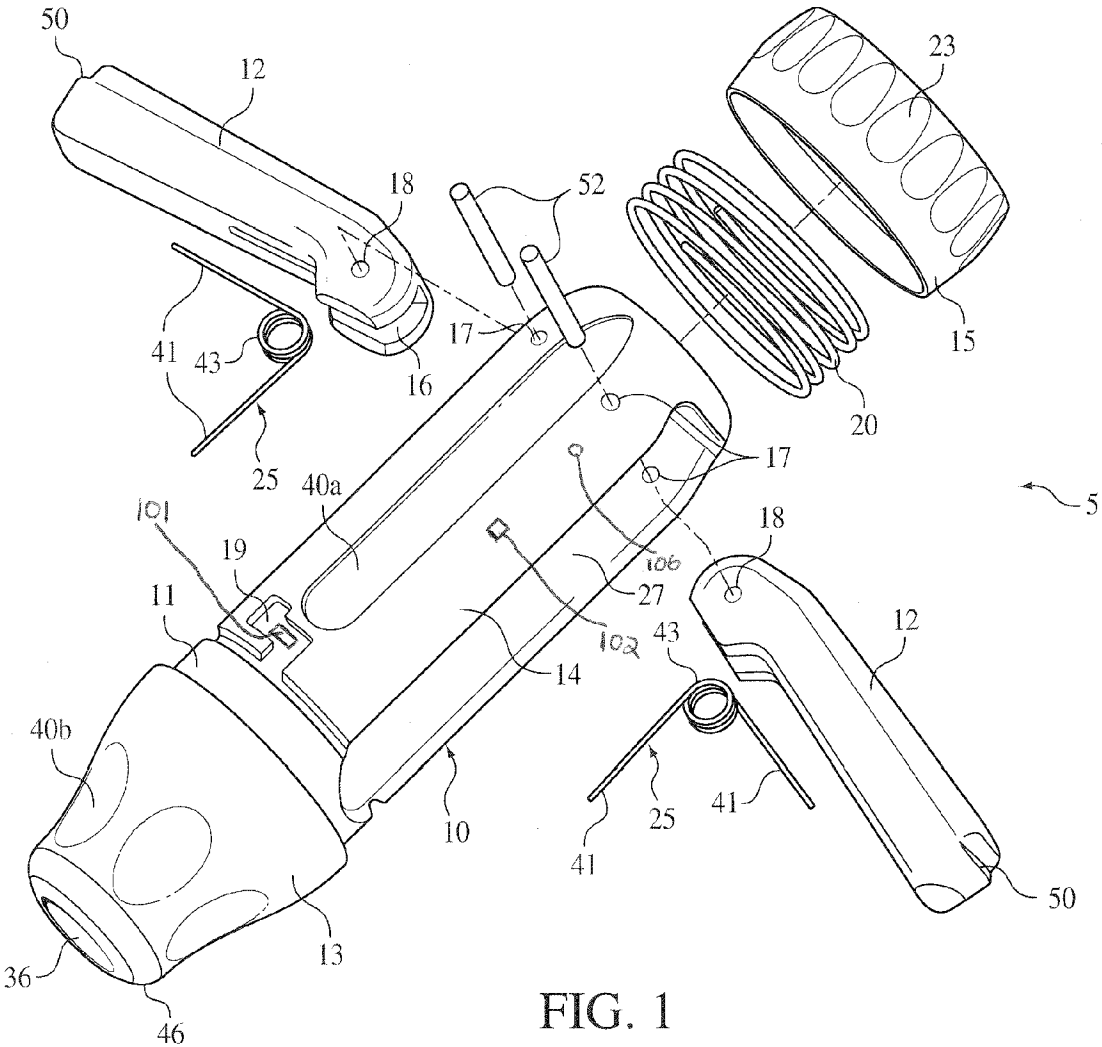
FIG. 1 illustrates an exploded view of a screwdriver handle according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

As mentioned, there remains a need for a novel screwdriver handle capable of allowing a user to use a power screwdriver in higher torque applications. The embodiments herein achieve this by providing a screwdriver handle having retractable arms to allow the user to apply greater torque while rotating the screwdriver. Referring now to the drawings and more particularly to FIGS. 1 through 9 where similar reference characters denote corresponding features consistently throughout the figures, there are shown preferred embodiments.

Figure 2:
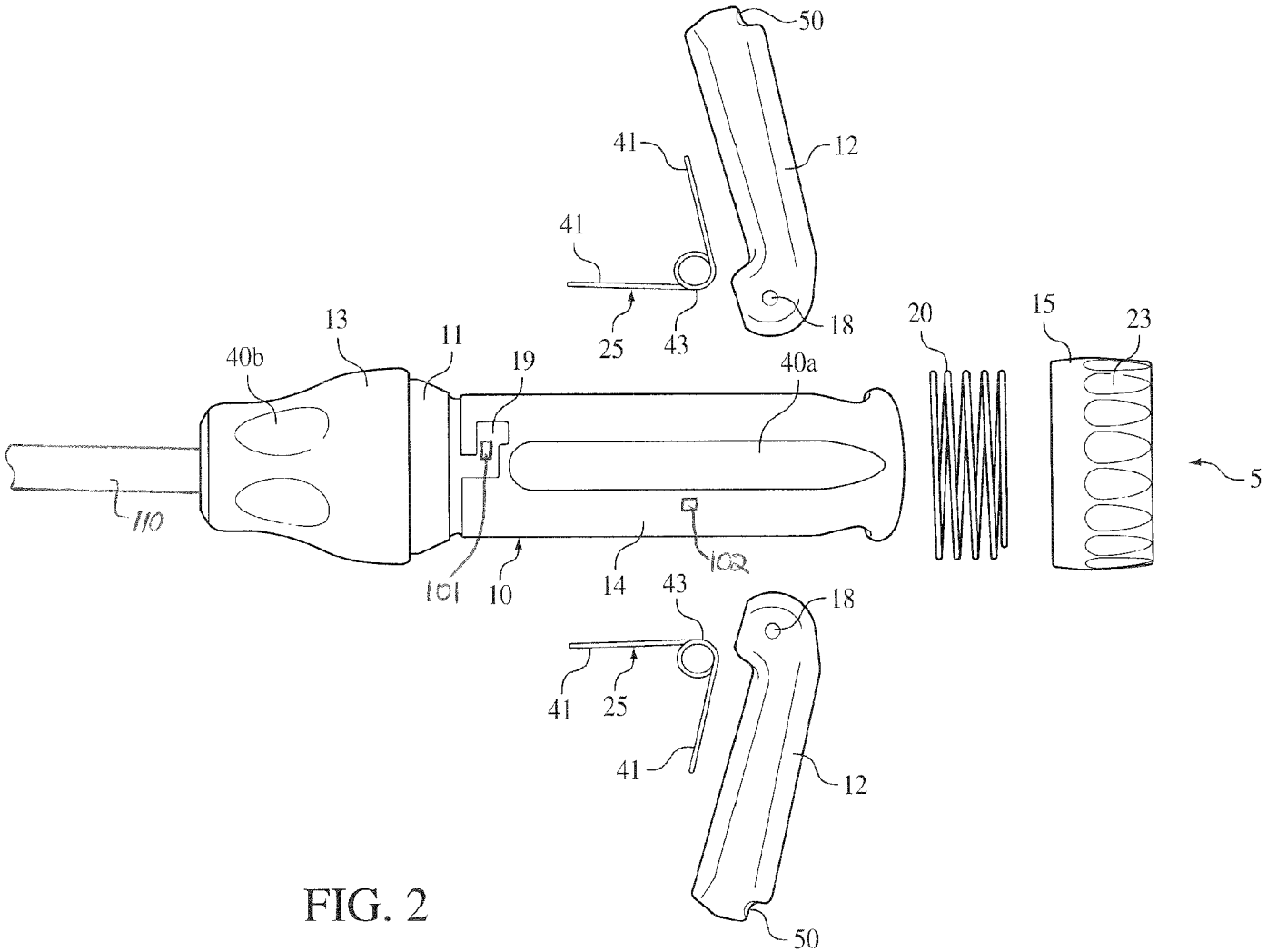
FIG. 2 illustrates an alternate exploded view of a screwdriver handle according to an embodiment herein.

FIGS. 1 and 2 illustrate exploded views of a screwdriver handle 5 according to an embodiment herein. The screwdriver handle 5 is preferably adapted to engage a shaft member 110 (shown in FIG. 2), which may be configured as a screwdriver shaft member or a wrench shaft member or any other elongated tool shaft member. Preferably, the screwdriver handle 5 comprises a generally elongated base portion 10 having an outer body surface 14 with at least one gripping indent feature 40*a* configured therein. However, those skilled in the art would readily appreciate that the screwdriver handle 5 may take any appropriate shape including non-elongated configurations such as spherical configurations. As such, the embodiments herein are not limited to one particular geometric configuration. The gripping indent feature 40*a* allows a user to securely grip the outer body surface 14 when using the screwdriver handle 5. The outer body surface 14 also includes a plurality of pin holes 17 configured through an upper portion of the base portion 10.

The base portion 10 further includes a pair of slotted regions 27 generally configured along the sides of the base portion 10 and generally extending the length of the base portion 10. The base portion 10 also includes a catch 19 generally configured towards the bottom of the outer body surface 14. The lower end 13 of the base portion 10 includes at least one gripping indent feature 40*b* configured therein. The gripping indent feature 40*b* allows a user to securely grip the lower end 13 of the base portion 10 when using the screwdriver handle 5. The lower end 13 includes a bottom surface 46 having a hole 36 configured therein. Furthermore, the base portion 10 includes a generally tapered joining segment 11 configured just above the lower end 13 and connecting to the catch 19.

The screwdriver handle 5 further includes a pair of arms 12 pivotally connected to the base portion 10, wherein the pair of arms 12 are preferably spaced apart from one another and are preferably not connected to one another. The arms 12 also include pin holes 18 similarly configured to the pin holes 17 of the base portion 10. Pins 52 are used to connect the arms 12 to the base portion 12, wherein the pin holes 17 of the base portion 10 are aligned with the pin holes 18 of the arms 12 and the pins 52 are inserted and secured into the aligned pin holes 17, 18, thereby securing the arms 12 to the base portion 10, while also allowing the arms 12 to pivotally articulate in relation to the base portion 10. Each arm 12 further includes an indented lip 50 preferably configured on the tip of the arm 12 located on the opposite end from where the pin holes 18 are configured.

The screwdriver handle 5 further includes a spring member 20 and a locking sleeve 15. The locking sleeve 15, which also includes gripping indent features 23, is generally positioned around the spring member 20. The gripping indent features 23 allow a user to securely grip the locking sleeve 15 when using the screwdriver handle 5. Additionally, the screwdriver handle 5 further comprises a torsion spring 25 connected to the base portion 10 and each of the pair of arms 12. The torsion spring 25 comprises a coiled central portion 43 and a pair of elongated ends 41 distally located from the coiled central portion 43.

The base portion 10 further includes a switch 102 that is positioned on the outer body surface 14 of the base portion. This switch 102 is electrically connected to a motor 100 (not shown in FIGS. 1 and 2). Furthermore, an electromechanical actuator 101 is positioned in the catch 19. The actuator 101 is also electrically connected to the motor 100 (not shown in FIGS. 1 and 2).

Figure 3:
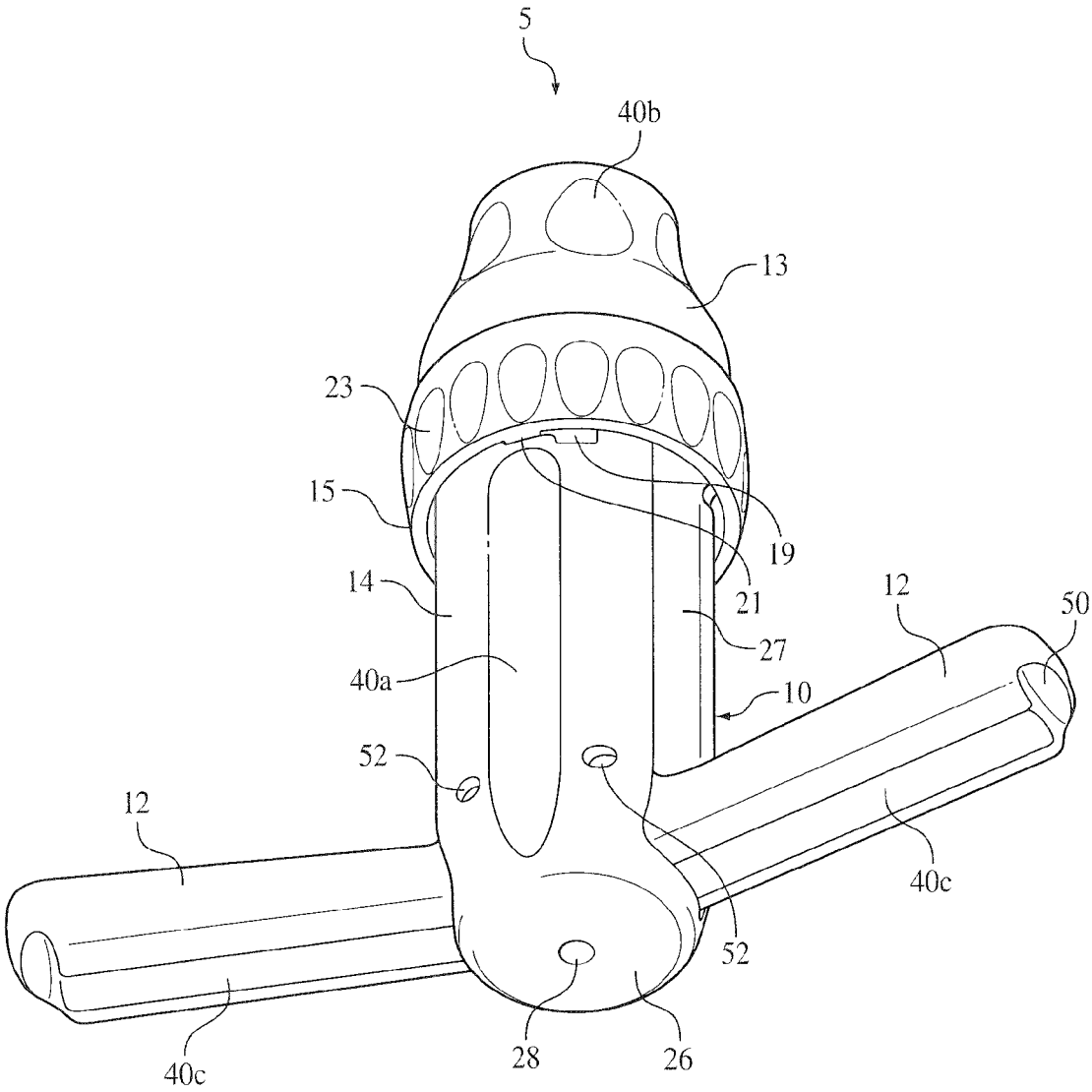
FIG. 3 illustrates a perspective view of a screwdriver handle in an open configuration according to an embodiment herein.

FIG. 3 illustrates the assembled screwdriver handle 5 with the pair of arms 12 in an open configuration; that is, in a position transverse to a longitudinal axis of the base portion 10. Here, the locking sleeve 15 is shown positioned next to the lower end 13 of the base portion 10 (around the tapered joining segment 11 (not shown in FIG. 3) of the base portion 10). The locking sleeve 15 includes a stop feature 21 which is dimensioned and configured to engage the catch 19 of the base portion 10 as well as to engage the actuator 101. In this regard, the catch 19 prevents the locking sleeve 15 from moving past the edge of the catch 19. Furthermore, the generally tapered shape of the joining segment 11 prevents the locking sleeve and underlying spring member 20 (not shown in FIG. 3) from moving onto and past the lower end 13 of the base portion 10. As shown in FIG. 3, the base portion includes a top surface 26 having a small hole 28 configured therein.

Moreover, FIG. 3 also illustrates that the arms 12 include a gripping indent feature 40*c* configured therein, wherein the gripping indent feature 40*c* is similarly configured to the gripping indent feature 40*a* of the outer body surface 14 of the base portion 10. The gripping indent feature 40*c* allows a user to securely grip the arms 12 (either in an open or closed configuration) when using the screwdriver handle 5.

Figure 4A:
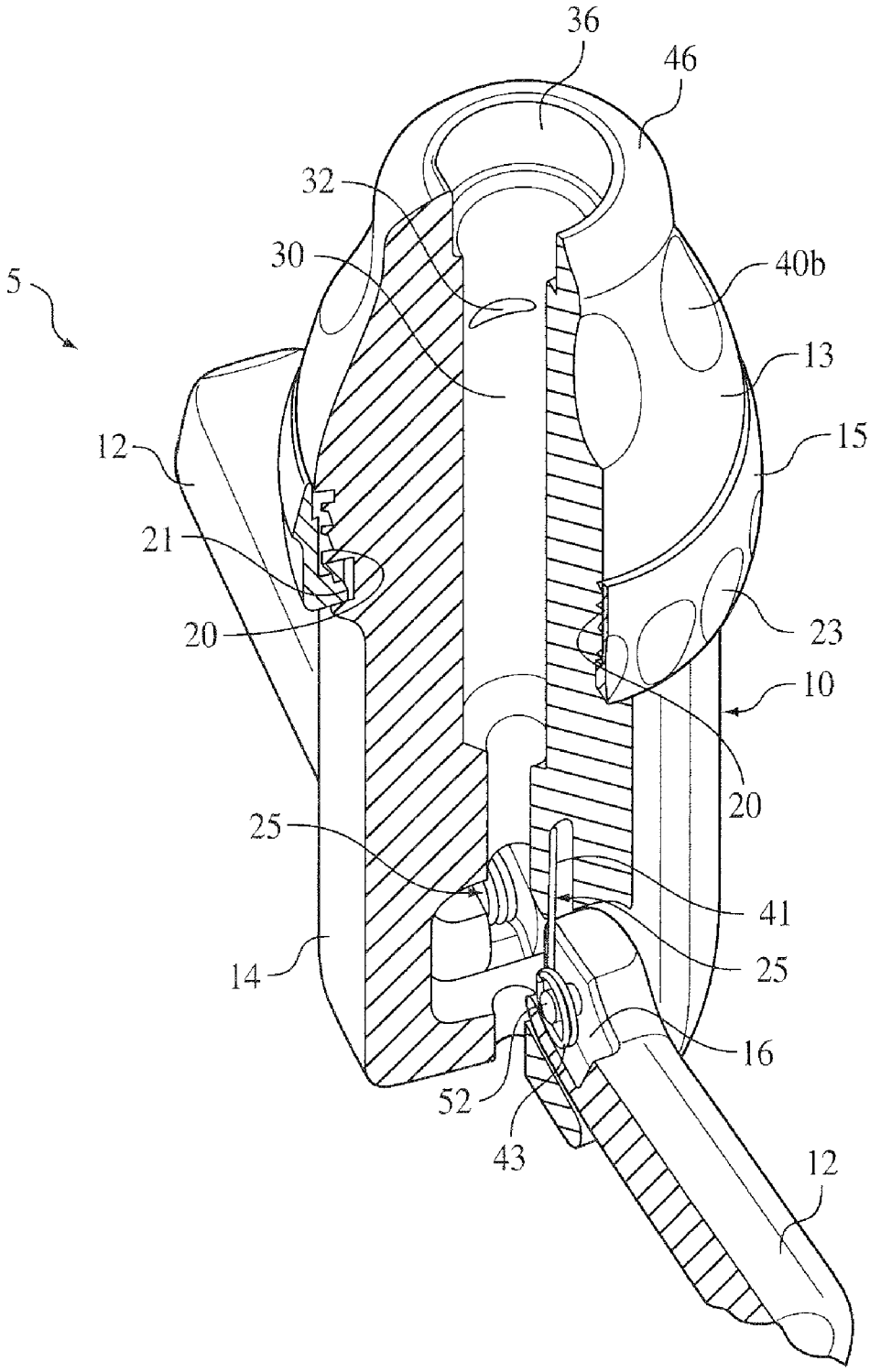
FIG. 4(A) illustrates a cross-sectional side view of a screwdriver handle in an open configuration according to a first embodiment herein.
Figure 4B:
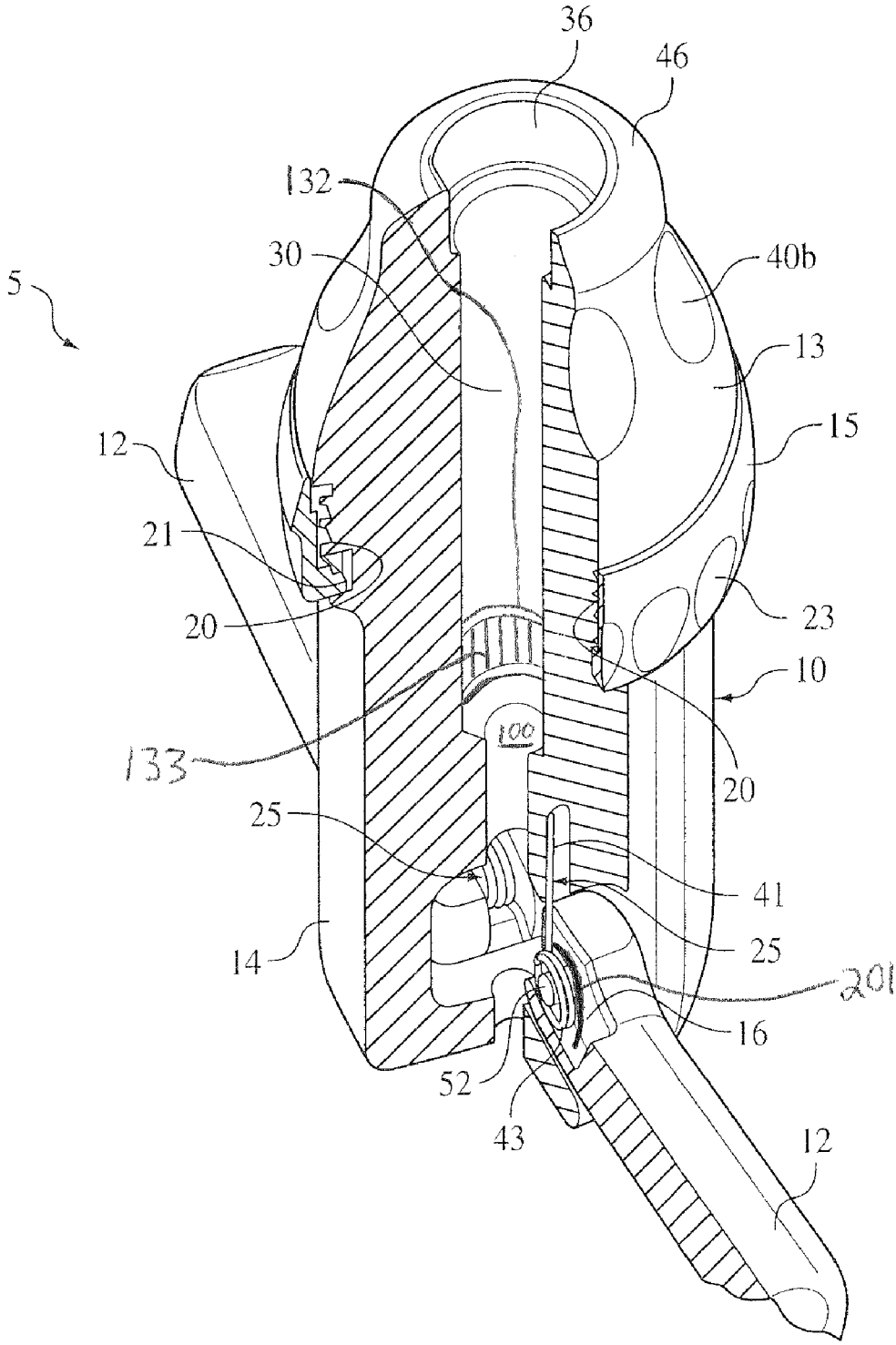
FIG. 4(B) illustrates a cross-sectional side view of a screwdriver handle in an open configuration according to a second embodiment herein.

The cross-sectional view of FIGS. 4(A) and 4(B) more particularly illustrate how the torsion spring 25 connects to the arm 12 and base portion 10 of the screwdriver handle 5. Generally, the torsion spring 25 fits into a slot 16 configured in the arm 12 and base portion 10. The coiled central portion 43 of the torsion spring 25 fits around the pin 52 with the elongated ends 41 being positioned in the slot 16 in each of the arms 12 and the base portion 10. The open configuration, which generally resembles a "T" shape, remains in this position due to the resistance provided by the torsion spring 25 against the arms 12.

Additionally, FIGS. 4(A) and 4(B) illustrate alternative embodiments. In FIGS. 4(A) and 4(B), a hollow inner shaft chamber 30 is configured in the base portion 10 and extending from the hole 36 of the bottom surface 46 of the base portion 10. The hole 36 is configured to accommodate a shaft (not shown in FIGS. 4(A) and 4(B)), which will engage a screw (not shown). Furthermore, the inner shaft chamber 30 includes a locking hole 32 shown in the first embodiment of FIG. 4(A), which accommodates a cross pin (not shown), which inserts into a corresponding shaft hole (not shown) thereby locking the shaft (not shown) in the inner shaft chamber 30, which thereby locks the shaft (not shown) to the screwdriver handle 5. An example, of a cross pin and shaft that may be used and the manner in which they are inserted and locked into a shaft chamber is described in U.S. patent application Ser. No. 11/063,452, filed Feb. 23, 2005, and entitled "Screwdriver", the contents of which, in its entirety, is herein incorporated by reference.

In the second embodiment of FIG. 4(B), a mount 132 is attached to the inner shaft chamber 30. The mount 132 comprises a rotatable gripper 133 that is configured in a gear-like configuration having tooth-like features that are adapted to matingly engage corresponding gear-like/tooth-like features of the shaft member 110.

Figure 5:
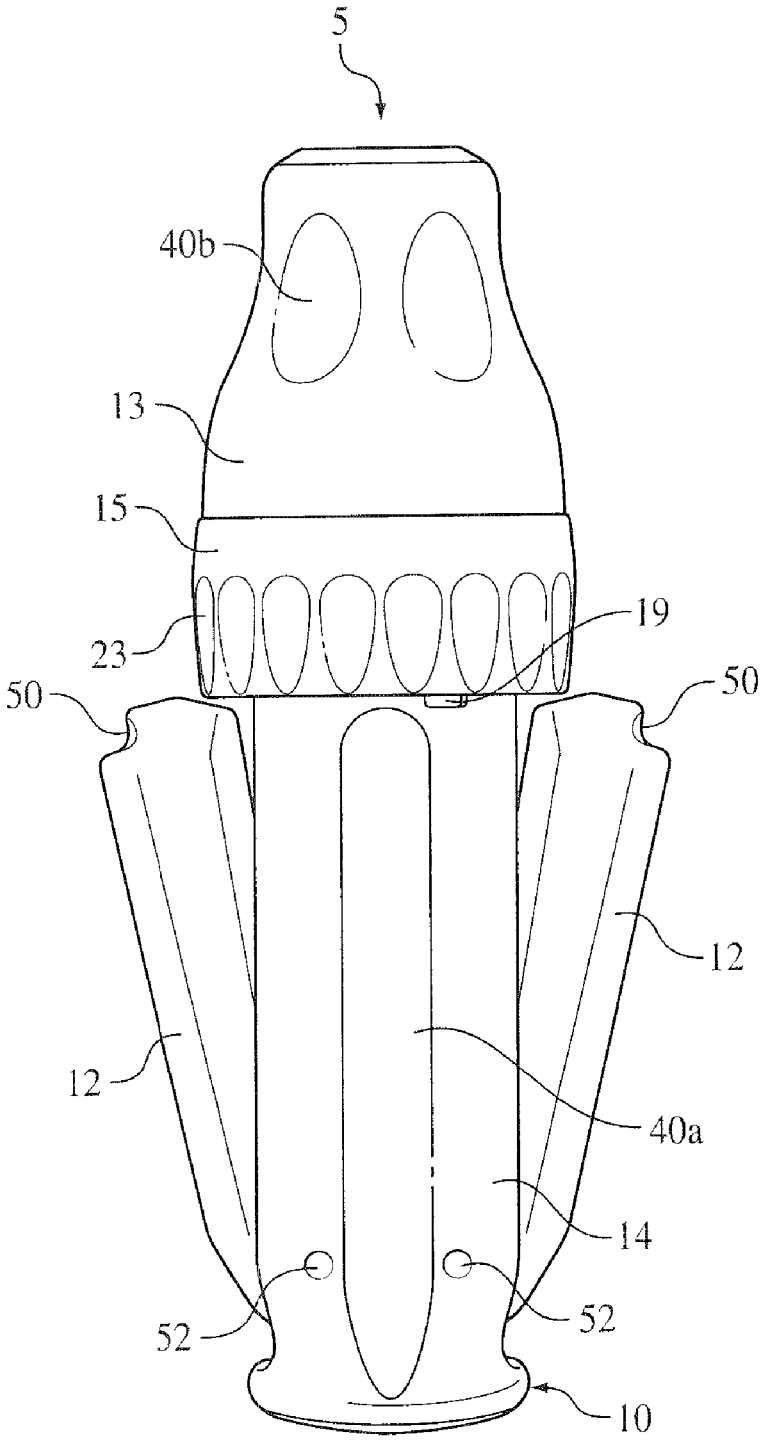
FIG. 5 illustrates a perspective view of a screwdriver handle in a partially closed configuration according to an embodiment herein.
Figure 6:
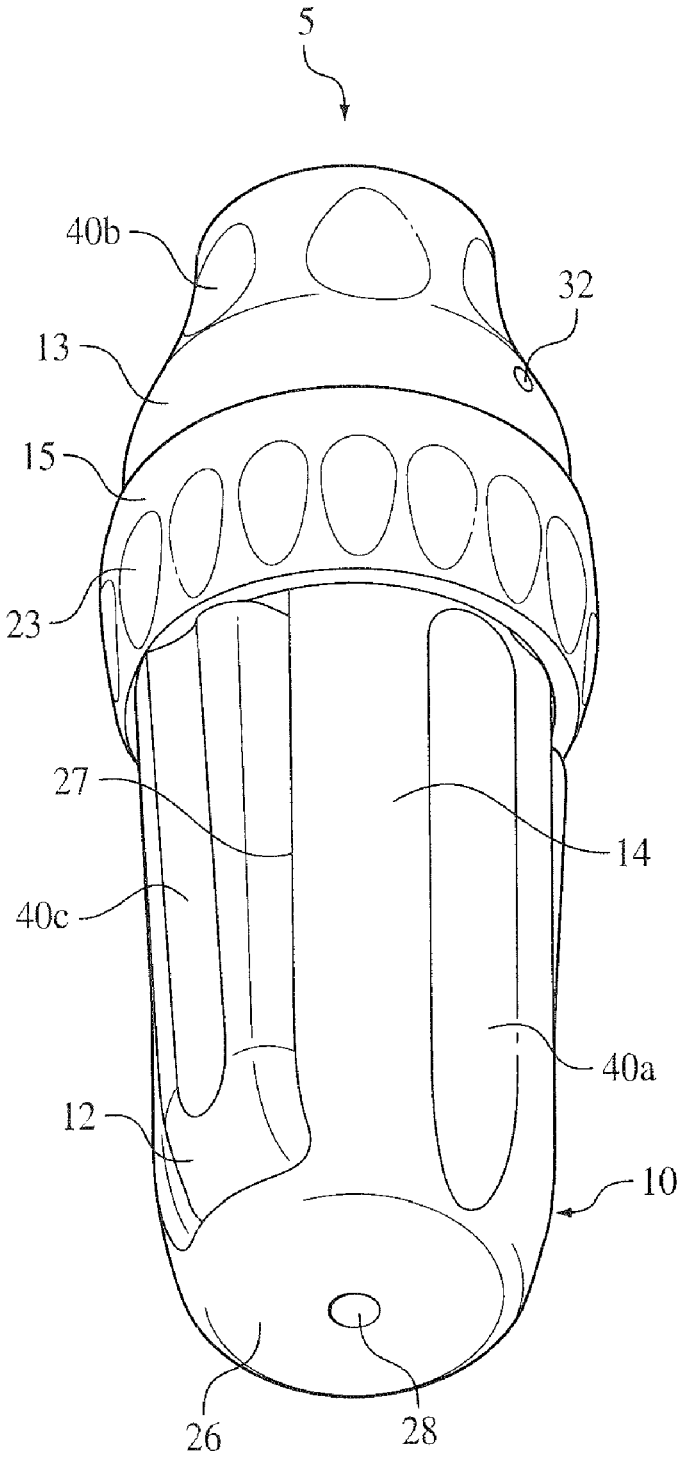
FIG. 6 illustrates a perspective view of a screwdriver handle in a closed configuration according to an embodiment herein.

FIG. 5 illustrates the screwdriver handle 5 in a partially closed configuration, whereby in order to move the screwdriver handle 5 from an open configuration to a closed configuration, a user (not shown) squeezes the arms 12 towards the base portion 10. FIG. 6 illustrates the screwdriver handle 5 in a closed configuration, whereby the arms 12 are positioned resting in the slotted regions 27 and generally planar to the longitudinal axis of the base portion 10.

Figure 7:
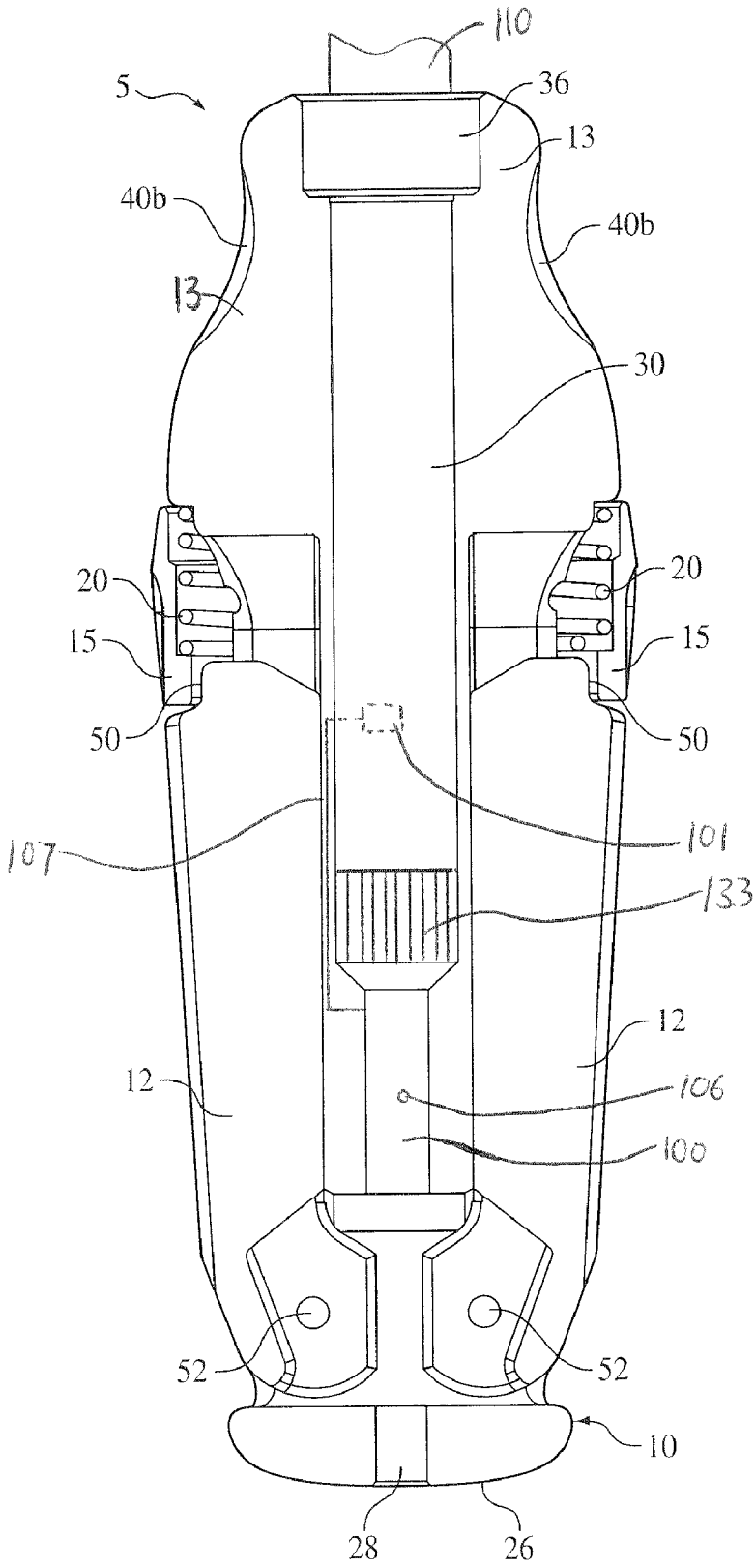
FIG. 7 illustrates a cross-sectional view of a screwdriver handle in a closed configuration according to an embodiment herein.

As illustrated in the cross-sectional view of FIG. 7, the arms 12 of the screwdriver handle 5 remains in the closed (locked) position when the locking sleeve 15 engages the indented lip 50 of the arm 12. This occurs when the spring member 20 extends to its natural/relaxed state thereby moving the locking sleeve 15 in a longitudinal direction away from the lower end 13 of the base portion 10. With reference to FIGS. 1 through 7, in order to once again open the arms 12 into a "T" shape configuration, the locking sleeve 15 slidably moves (with the aid of a user) along the longitudinal axis of the base portion 10 in a direction towards the lower end of the base portion 10. In doing so, the spring member 20 is pushed into a coiled configuration because the spring member 20 is connected to and is held in place by the sleeve member 15. Once the locking sleeve 15 releases the indented lip 50 of the arms 12, the arms 12 are released and pivotally rotated on the pins 52 into the "T" shape (open) configuration.

Thus, the torsion spring 25 accumulates potential energy when the arms 12 are pushed into the slotted region 27 (i.e., the arms are in the closed position). Furthermore, this potential energy is retained so long as the arms 12 are squeezed against the base portion 10, and preferably held in place by the locking sleeve 15. When, the locking sleeve 15 is moved toward the lower end 13 of the base portion 10, then the potential energy of the torsion springs 25 are released, thereby creating kinetic energy causing the arms 12 to pivot outward into the open "T" shape configuration.

The spring member 20 accumulates potential energy when the locking sleeve 15 moves toward the lower end 13 of the base portion because in this position the spring member 20 is in a coiled configuration. When, the spring member 20 is released from its coiled state back to its natural/relaxed configuration, the stored potential energy in the spring member 20 transfers into kinetic energy, thereby causing the locking sleeve 15 to move away from the lower end 13 of the base portion 10. However, the locking sleeve 15 is prevented from moving any further than the position of the catch 19 of the base portion 10. Thus, due to the catch 19 and the limited translation of the locking sleeve 15 along the longitudinal axis of the base portion 10 in a direction away from the lower end 13 of the base portion, there always remains some potential energy stored in the spring member 20. Accordingly, the catch 19 prevents the locking sleeve 15 and spring member 20 from falling off of the screwdriver handle 5 on one side, while the tapered configuration of the tapered joining segment 11 prevents the locking sleeve 15 and spring member 20 from falling off of the screwdriver handle 5 on the other side.

FIG. 7 illustrates the screwdriver handle 5 with an electric motor 100 attached thereto. Any appropriate conventional motor that is typically used in electric power tools, such as electric power screwdrivers, may be used in accordance with the embodiments herein. The electric motor 100 may facilitate automated rotation (clockwise and counter-clockwise) of an attached screwdriver shaft 110. For clarity, in FIG. 7, only the portion of the shaft 110 extending outward from the handle 5 is shown, whereby that portion of the shaft 110 that is retained in the inner shaft chamber 30 is not shown in FIG. 7 to allow for other features of the handle 5 to be visible in the drawing. The electric motor 100 may be housed within the base portion 10, and at any suitable location within the base portion 10, and may be electrically driven by attached batteries (not shown) or may comprise capacitive elements (not shown) that retain an predetermined capacity of electric charge, wherein these capacitive elements may be electrically recharged via an adapter jack 106 using an electric adapter (not shown) connected to a power supply (not shown).

The screwdriver handle 5 may operate with the electric motor 100 in the following manner. First, taking the example of driving a screw, bolt, pin, etc. (not shown) into another object (not shown), the screwdriver handle 5 is connected to the gripper 133, which connects to a screwdriver shaft 110, which is then attached to the screw being driven. A user may turn on the motor switch 102 (in the forward option), which engages the motor 100 to rotate the gripper 133 and corresponding screwdriver shaft 110. The screwdriver shaft 110 then rotates the screw into the object until it reaches a resistance point past which the electric torque of the motor 100 does not exceed, thereby preventing additional rotation of the screw into the object. At this point, the user can simply turn the motor switch 102 off thereby stopping the motor 100 and corresponding rotation of the gripper 133 and screwdriver shaft 110, and then can use the screwdriver handle 5 as described above, whereby the locking sleeve 15 slidably moves (with the aid of a user) along the longitudinal axis of the base portion 10 in a direction towards the lower end 13 of the base portion 10. In doing so, the spring member 20 is pushed into a coiled configuration because the spring member 20 is connected to and is held in place by the sleeve member 15. Once the locking sleeve 15 releases the indented lip 50 of the arms 12, the arms 12 are released and pivotally rotated on the pins 52 into the "T" shape (open) configuration. Thus, the user can rotate the screwdriver handle 5 and corresponding connected screwdriver shaft 110 and attached screw manually to provide increased torque to the driving action.

Next, taking the example of removing a screw, bolt, pin, etc. (not shown) from another object (not shown), the screwdriver handle 5 is connected to the gripper 133, which connects to a screwdriver shaft 110, which is then attached to the screw being driven. Again, the user slidably moves the locking sleeve 15 along the longitudinal axis of the base portion 10 in a direction towards the lower end 13 of the base portion 10. In doing so, the spring member 20 is pushed into a coiled configuration because the spring member 20 is connected to and is held in place by the sleeve member 15. Once the locking sleeve 15 releases the indented lip 50 of the arms 12, the arms 12 are released and pivotally rotated on the pins 52 into the "T" shape (open) configuration. Thus, the user can rotate the screwdriver handle 5 and corresponding connected screwdriver shaft 110 and attached screw manually to provide increased torque to the reverse-driving action. Once, the user feels that the amount of resistance being offered by the screw that is being removed is below a torque threshold of the motor 100, the user may turn on the motor switch 102 (in the reverse option), which engages the motor 100 to rotate the corresponding screwdriver shaft 110. The screwdriver shaft 110 then rotates the screw (in the reverse motion) until it has been removed from the object.

In the embodiment shown in FIG. 4(A), when the motor 100 is engaged, both the screwdriver shaft 110 and the screwdriver handle 5 rotate because the shaft 110 is held into place via the cross pin (not shown) attached to the locking hole 32. In the preferred embodiment shown in FIG. 4(B), when the motor 100 is engaged, only the screwdriver shaft 110 rotates (i.e., the screwdriver handle 5 does not rotate). In this embodiment, the arms 12 of the screwdriver handle 5 may be in the open or closed position when the motor 100 is on.

In another embodiment, when the motor 100 is engaged, the locking sleeve 15 is prevented from being slidably engaged. That is, the motor 100 is attached to an electromechanical actuator 101, via electric line 107, which retains the locking sleeve 15 in a locked position thereby preventing the arms 12 from being pivotally rotated. In FIG. 7, the actuator 101 is shown in dotted lines to reflect that it is not positioned on the inner surface of the inner shaft chamber 30. If the arms 12 are in the open configuration before the motor 100 is engaged, then once the motor 100 is turned on, the arms 12 may be prevented from being pivotally rotated back into a closed configuration using a second actuator 201 (shown in FIG. 4(B)) connecting the arms 12 (via torsion spring 25) to the electric motor 100. Alternatively, if the arms 12 are in the closed configuration before the motor 100 is engaged, then once the motor 100 is turned on, the arms 12 are prevented from being pivotally rotated into an open configuration again using the second actuator 401. Preferably, only the screwdriver shaft 110 rotates and the screwdriver handle 5 does not rotate.

In another embodiment, when the arms 12 are in the open position, the actuators 101, 102 sends an electric signal to the electric motor 100 that disables the motor 100 from turning on even when the switch 102 is engaged. Furthermore, not until the arms 12 are fixed in their closed position and locked into place by the locking sleeve 15 does the actuator 101 then enable the motor 100 to turn on and be operable.

Figure 8:
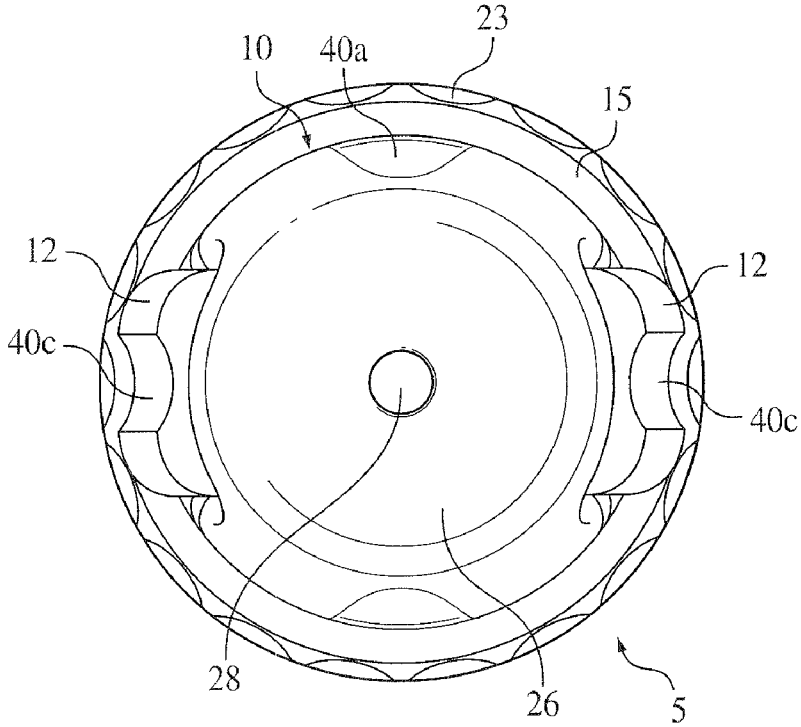
FIG. 8 illustrates a top view of a screwdriver handle according to an embodiment herein.
Figure 9:
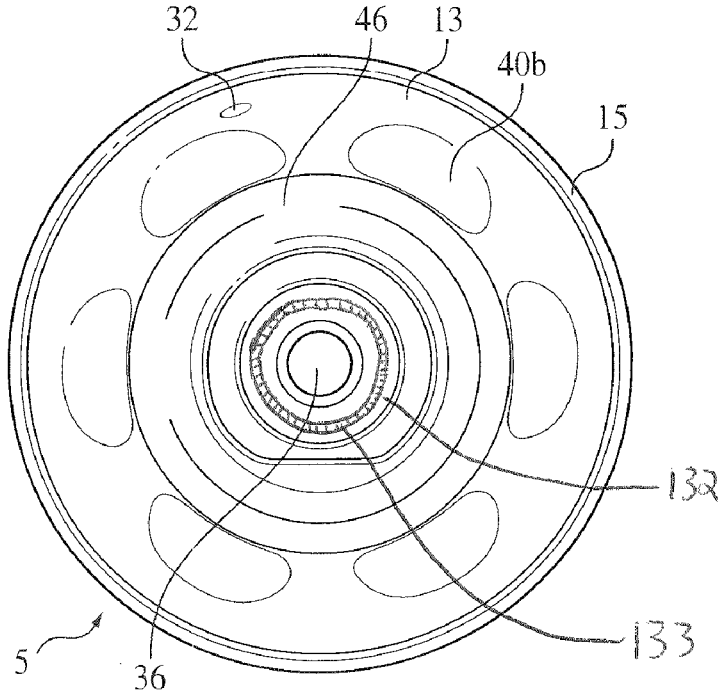
FIG. 9 illustrates a bottom view of a screwdriver handle according to an embodiment herein.

FIGS. 8 and 9 illustrate the top and bottom views of the screwdriver handle 5, respectively. These views illustrate the generally round configuration of the screwdriver handle 5, although, as previously mentioned, any shape configuration may be incorporated into the design of the screwdriver handle 5, and the embodiments of the limitation are not limited to any particular shape configuration.

Generally, as illustrated in FIGS. 1 through 9, the embodiments herein provide a screwdriver handle 5 comprising a base portion 10 adapted to accommodate a screwdriver shaft member 110; an electric motor 100 operatively connected to the base portion 10 and adapted to rotate the screwdriver shaft member 110 in any of a clockwise and counter-clockwise manner; and a pair of arms 12 connected to the base portion 10, wherein the pair of arms 12 are diametrically opposed to one another at a position transverse to a longitudinal axis of the base portion 10. The screwdriver handle 5 further comprises a locking sleeve 15 mounted around the base portion 10 and adapted to engage the pair of arms 12; a spring member 20 mounted around the base portion 10 and adapted to engage the locking sleeve 15; and a torsion spring 25 connected to the base portion 10 and each of the pair of arms 12. Preferably, the base portion 10 comprises a hollow inner shaft chamber 30, and wherein the base portion 10 comprises at least one gripping indent feature 40*a*, 40*b*.

The screwdriver handle 5 may further comprise a switch 102 adapted to turn the motor 100 on and off. Additionally, the screwdriver handle 5 may further comprise an electromechanical actuator 101 operatively connected to each of the electric motor 100 and the locking sleeve 15. Preferably, the locking sleeve 15 is adapted to move along a longitudinal axis of the base portion 10, and wherein the electromechanical actuator 101 is adapted to prevent the locking sleeve 15 from moving along the longitudinal axis of the base portion 10.

Additionally, the pair of arms 12 are adapted to articulate from a first position planar to a longitudinal axis of the base portion 10 to a second position transverse to the longitudinal axis of the base portion 10, wherein the pair of arms 12 are diametrically opposed to one another when in the second position. The screwdriver handle 5 further comprises a pin 52 connecting the pair of arms 12 to the base portion 10. Moreover, the locking sleeve 15 is adapted to move along a longitudinal axis of the base portion 10. Preferably, the pair of arms 12 are unconnected to one another.

The screwdriver handle 5 provided by the embodiments herein may be used in any application where a screwdriver is used, and is particularly useful in heavy torque applications, where a user can open the arms 12 and apply greater torque on a screw by rotating the arms 12 of the screwdriver handle 5. Furthermore, in instances where the user does not need to apply significant amounts of torque to a screw or in applications where there are spatial limitations, the arms 12 can be kept in the locked position (i.e., with the locking sleeve 15 engaging the indented lip 50 of the arms 12), and the screwdriver handle 5 may be used in a traditional manner. In this regard, because the gripping indent features 40*c* of the arms 12 contours with the shape and configuration of the gripping indent features 40*a* of the outer body surface 14 of the base portion 10, a user can get a very good ergonomic grip on the screwdriver handle 5. Moreover, the matching shape and configuration of the gripping indent features 40*a*, 40*c* contributes to the overall aesthetics of the screwdriver handle 5.

The screwdriver handle 5 is particularly useful together with the power mode such that torque limits beyond the capability of the motor 100 may be reached using the mechanical (manual) aspect of the handle 5 after the user has exhausted the limits afforded by the motor 100.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A screwdriver handle comprising:

a base portion comprising an opening that accommodates a screwdriver shaft member;

a locking sleeve mounted around and external to said base portion;

at least one arm pivotally connected to said base portion and positioned at an end of said base portion that is positioned opposite from said opening, wherein said at least one arm comprises an indented lip that engages said locking sleeve, wherein said indented lip is positioned at a tip of said at least one arm, wherein said locking sleeve moves along a longitudinal axis of said base portion to expand said at least one arm from a first position planar to said longitudinal axis of said base portion to a second position transverse to said longitudinal axis of said base portion; and an electric motor operatively connected to said base portion, wherein said electric motor rotates said screwdriver shaft member in any of a clockwise and counter-clockwise manner.

2. The screwdriver handle of claim 1, further comprising a switch that turns said electric motor on and off.

3. The screwdriver handle of claim 1, further comprising an electromechanical actuator operatively connected to each of said electric motor and said locking sleeve.

4. The screwdriver handle of claim 3, wherein said electromechanical actuator prevents said locking sleeve from moving along said longitudinal axis of said base portion.

5. The screwdriver handle of claim 1, wherein during said second position, said screwdriver handle is only manually rotatable using said at least one arm to transmit torque to said screwdriver shaft member.

6. The screwdriver handle of claim 1, wherein said electric motor is disabled when said at least one arm is in said second position.

7. The screwdriver handle of claim 1, wherein said at least one arm comprises two arms, and wherein said two arms are diametrically opposed to one another when in said second position.

8. The screwdriver handle of claim 1, further comprising a pin connecting said at least one arm to said base portion, wherein said base portion comprises at least one gripping indent feature.

9. The screwdriver handle of claim 1, wherein said locking sleeve engages said indented lip of said at least one arm.

10. The screwdriver handle of claim 1, wherein said at least one arm comprises a pair of arms that are unconnected to one another.

11. A tool handle comprising:

a base portion comprising an opening that accommodates a shaft member;

locking means operatively connected around said base portion;

a pair of arms operatively connected to an end of said base portion that is positioned opposite to said opening of said base portion, wherein said pair of arms are diametrically opposed to one another at a position transverse to a longitudinal axis of said base portion, and wherein said pair of arms comprise a lip that engages said locking means, wherein said lip is positioned at a tip of said pair of arms; and an electric motor operatively connected to said base portion, wherein said electric motor is disabled when said pair of arms are in said position transverse to said longitudinal axis of said base portion.

12. The tool handle of claim 11, further comprising:

a spring member mounted around said base portion, wherein said spring member engages said locking means;

a torsion spring connected to said base portion and each of said pair of arms; and an electromechanical actuator operatively connected to each of said electric motor and said locking means, wherein said base portion comprises a catch, and wherein said locking means comprises a stop feature that engages said catch.

13. The tool handle of claim 11, wherein said base portion comprises a hollow inner shaft chamber.

14. The tool handle of claim 11, wherein said shaft member comprises any of a screwdriver shaft member and a wrench shaft member.

15. The tool handle of claim 11, wherein said pair of arms articulate from a first position planar to a longitudinal axis of said base portion to a second position transverse to said longitudinal axis of said base portion.

16. The tool handle of claim 15, wherein said pair of arms are diametrically opposed to one another when in said second position.

17. The tool handle of claim 11, further comprising a pin connecting said pair of arms to said base portion, wherein said base portion comprises at least one gripping indent feature.

18. The tool handle of claim 11, wherein said locking means moves along a longitudinal axis of said base portion.

19. The tool handle of claim 11, wherein said pair of arms are unconnected to one another.

20. A tool handle comprising:

a base portion comprising a first end comprising an opening that accommodates a rotatable shaft member;

a pair of arms pivotally connected to said base portion, wherein said pair of arms are positioned at a second end of said base portion that is located opposite to said first end;

locking means for locking said pair of arms in a first position planar to a longitudinal axis of said base portion, wherein said locking means is positioned external to said base portion;

first energy means for providing energy to said locking means to articulate from a locked to an unlocked position;

second energy means for providing energy to said pair of arms to articulate from said first position planar to said longitudinal axis of said base portion to a second position transverse to said longitudinal axis of said base portion; and electric power means for providing power to rotate said rotatable shaft member, wherein said electric power means is disabled when said pair of arms are in said second position, wherein said pair of arms comprise a lip that engages said locking means, and wherein said lip is positioned at a tip of said pair of arms.

* * * * *